US008401208B2

(12) United States Patent
Ceballos et al.

(10) Patent No.: US 8,401,208 B2
(45) Date of Patent: Mar. 19, 2013

(54) ANTI-SHOCK METHODS FOR PROCESSING CAPACITIVE SENSOR SIGNALS

(75) Inventors: Jose Luis Ceballos, Villach (AT); Michael Kropfitsch, Koettmannsdorf (AT)

(73) Assignee: Infineon Technologies AG, Neubiberg (DE)

( * ) Notice: Subject to any disclaimer, the term of this patent is extended or adjusted under 35 U.S.C. 154(b) by 1400 days.

(21) Appl. No.: 11/940,150

(22) Filed: Nov. 14, 2007

(65) Prior Publication Data

US 2009/0121778 A1 May 14, 2009

(51) Int. Cl.
*H04R 3/00* (2006.01)

(52) U.S. Cl. ..... 381/122; 381/120

(58) Field of Classification Search ..... 381/122
See application file for complete search history.

(56) References Cited

U.S. PATENT DOCUMENTS

| | | | | |
|---|---|---|---|---|
| 3,365,546 | A * | 1/1968 | Kemper | 381/94.5 |
| 5,097,224 | A * | 3/1992 | Madaffari et al. | 330/277 |
| 5,774,557 | A * | 6/1998 | Slater | 381/56 |
| 6,353,344 | B1 * | 3/2002 | Lafort | 327/108 |
| 6,453,048 | B1 * | 9/2002 | Akino | 381/113 |
| 6,462,685 | B1 * | 10/2002 | Korkala | 341/131 |
| 6,784,744 | B2 * | 8/2004 | Tichauer | 330/285 |
| 6,859,102 | B2 * | 2/2005 | Tichauer | 330/285 |
| 7,323,922 | B1 * | 1/2008 | Jones | 327/308 |
| 2001/0053228 | A1 * | 12/2001 | Jones | 381/71.6 |
| 2003/0048698 | A1 * | 3/2003 | Barnes et al. | 367/181 |
| 2003/0194100 | A1 * | 10/2003 | Boor | 381/111 |
| 2003/0199130 | A1 * | 10/2003 | Lafort | 438/199 |
| 2004/0131210 | A1 * | 7/2004 | Kern | 381/120 |
| 2004/0160245 | A1 * | 8/2004 | Brooks et al. | 327/65 |
| 2005/0134384 | A1 * | 6/2005 | Sato | 330/277 |
| 2005/0151589 | A1 * | 7/2005 | Fallesen | 330/259 |
| 2005/0164631 | A1 * | 7/2005 | Jin | 455/12.1 |
| 2006/0008097 | A1 * | 1/2006 | Stenberg et al. | 381/113 |
| 2006/0062406 | A1 * | 3/2006 | Kinoshita | 381/113 |
| 2006/0147061 | A1 * | 7/2006 | Niwa et al. | 381/113 |
| 2006/0147062 | A1 * | 7/2006 | Niwa et al. | 381/113 |
| 2006/0285703 | A1 * | 12/2006 | Akino | 381/113 |
| 2006/0291672 | A1 * | 12/2006 | Akino | 57/58.49 |
| 2007/0160234 | A1 * | 7/2007 | Deruginsky et al. | 381/113 |
| 2007/0279097 | A1 * | 12/2007 | Cheng et al. | 326/83 |
| 2009/0003629 | A1 * | 1/2009 | Shajaan et al. | 381/113 |
| 2009/0015337 | A1 * | 1/2009 | Li et al. | 330/296 |
| 2009/0086992 | A1 * | 4/2009 | Hsu et al. | 381/92 |
| 2009/0316935 | A1 * | 12/2009 | Furst et al. | 381/111 |
| 2010/0013501 | A1 * | 1/2010 | Van Den Boom | 324/679 |
| 2010/0295614 | A1 * | 11/2010 | Fujita et al. | 330/207 P |

FOREIGN PATENT DOCUMENTS

| | | | |
|---|---|---|---|
| WO | 2004/098237 | A1 | 11/2004 |
| WO | 2006/033261 | A1 | 3/2006 |
| WO | 2006/033269 | A1 | 3/2006 |

OTHER PUBLICATIONS

CN Office Action; Nov. 16, 2011, Appl. No. 200810181470.7, filed Nov. 14, 2008.
Translation of CN Office Action; Nov. 16, 2011, Appl. No. 200810181470.7, filed Nov. 14, 2008.

* cited by examiner

*Primary Examiner* — Robert J Hoffberg
*Assistant Examiner* — Igwe U Anya
(74) *Attorney, Agent, or Firm* — SpryIP, LLC

(57) ABSTRACT

A low impedance coupling to bias voltage dissipates abnormal charge levels within a microphone in response to a shock event such as dropping or bumping. High impedance coupling to bias voltage is thereafter restored.

26 Claims, 4 Drawing Sheets

ANTI-SHOCK METHODS FOR PROCESSING CAPACITIVE SENSOR SIGNALS

BACKGROUND

Numerous circuits and devices use microphones for sensing acoustic information such as speech, music, etc. Non-limiting examples of such devices include cellular telephones, digital and tape-based audio recorders, and so on. One general class of microphones utilizes a capacitive membrane. When electrically biased by way of appropriate circuitry, a time-varying electrical charge is present across the capacitive element in accordance with incident acoustic energy. Thus, a capacitive microphone provides an electrical signal representative of the sound energy detected by the microphone.

Capacitive microphones exhibit an undesirably long recovery time when subjected to a "big signal" event, or shock, such as occurs when the microphone is bumped by a solid object, is subjected to an unusually loud sound, etc. This is due to the fact that capacitive microphones and their associated biasing circuitry define an appreciably long time constant (i.e., tau), some being on the order of tens of seconds. A corresponding period of important acoustic information (e.g., speech) can go undetected by the microphone while the capacitive element is re-biased to normal operating signal levels. The slow recovery of capacitive microphones subjected to shock events is undesirable.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Disclosed herein are biasing circuits for use with capacitive microphones. According to one implementation, a biasing circuit applies a biasing voltage to one node of a microphone at very high impedance during normal, sound detecting operations. Abnormally high or low charges stored by the microphone—usually resulting from a shock event—are detected by the biasing circuitry. In response, a low impedance electrical coupling is established between the microphone and the biasing voltage source. High impedance coupling to the bias voltage source is restored once the microphone returns to normal operating levels. Circuit structures provided herein can be fabricated, at least in part, on a common substrate such that respective integrated circuit devices are defined. In one or more embodiments, at least a portion of drive circuits presented herein can be fabricated within a 65 nanometer (or smaller) environment.

The techniques described herein may be implemented in a number of ways. One illustrative context is provided below with reference to the included figures and ongoing discussion.

Illustrative Environment

Figure 1:
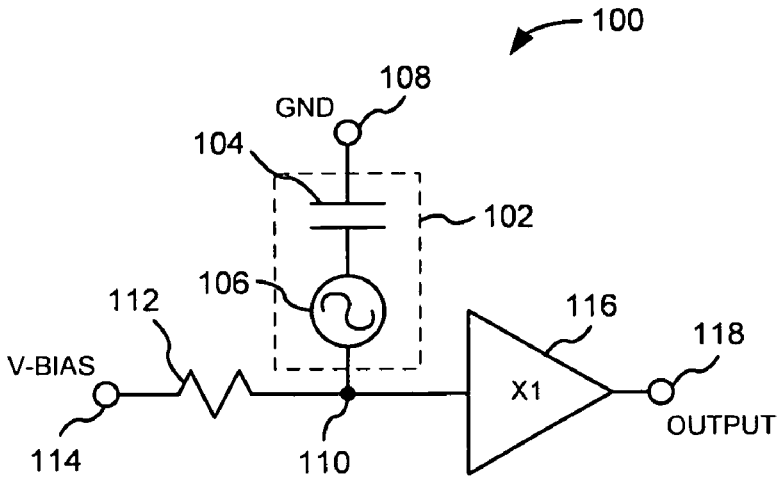
FIG. 1 (Prior Art)
FIG. 1 is a schematic diagram of a biasing circuit in accordance with one implementation.

FIG. 1 shows an illustrative circuit 100 in accordance with known techniques. The circuit 100 depicts known capacitive microphone biasing and signal buffering circuitry. The circuit 100 includes a capacitive microphone equivalent circuit (Ceq) 102. The Ceq 102 includes a capacitive element 104 and a signal generator 106. The capacitive element 104 represents the capacitive (i.e., charge storage) characteristics of a capacitive-type microphone. In turn, the signal generator 106 represents time-varying electrical signals provided by a capacitive microphone in response to incident sound energy. One of ordinary skill in the electrical engineering arts can appreciate that the Ceq 102 provides a simplified model including salient aspects of a corresponding capacitive microphone. The Ceq 102 is coupled to ground potential at a node 108, and provides electrical signals corresponding to detected sound energy at a node 110. In the alternative (not shown), the Ceq 102 could also be coupled to a potential other than ground at node 108. Furthermore, various values of biasing resistors 112 can also be used.

Circuit 100 also includes a resistive element (i.e., resistor) 112. The resistor 112 is typically of a relatively high Ohmic value such as, for example, two mega-ohms (i.e., $2\times10^6$ Ohms) in electrical resistance. Other suitable values of resistor 112 can also be used. The resistor 112 must generally be of a high Ohmic value in order to keep the signal-to-noise ratio (SNR) of the circuit 100 within acceptable tolerances. The resistor 112 electrically couples the Ceq 102 at node 110 to a source of bias voltage (V-BIAS) at a node 114. In one illustrative and non-limiting implementation, the value of V-BIAS is two volts DC (direct current). The Ceq 102 and the resistor 112 cooperate to provide a quiescent operating voltage equal to V-BIAS at the node 110, with electrical signals representative of detected sound superimposed thereon.

The circuit 100 also includes a buffer amplifier (buffer) 116. As depicted in FIG. 1, the buffer 116 is a unity gain (i.e., gain of one) amplifier. Other buffers 116 having correspondingly different gain factors can also be used. The buffer 116 exhibits relatively high input impedance (e.g., typically many mega-ohms) and generally low output impedance. The buffer 116 is connected to receive electrical signals at node 110 and to provide a corresponding output signal at a node 118.

During typical operation, the microphone represented by Ceq 102 is subjected to incident sound energy such as speech, music, and so on. That sound energy results in pressure variations against the microphone's capacitive membrane, as represented by the capacitor 104. These pressure variations cause the capacitive membrane to flex resulting in time-varying changes in the capacitive value (i.e., in picofarads, etc.) and, in turn, the electrical charge stored within the Ceq 102. These variations in the stored electrical charge are manifest as electrical signals at node 110. The electrical signals at node 110 vary within some normal operating range typically, but not necessarily, centered about V-BIAS potential.

When the Ceq 102 is subjected to a shock event such as, for example, dropping the microphone onto a table surface, an abnormal value of electrical charge (i.e., voltage) is stored across the capacitor 104. This abnormally high (or low) electrical charge has an absolute voltage value substantially greater than the biasing potential V-BIAS. As a net result, the Ceq 102 is not capable of providing usable electrical signal information at node 110 until the excess charge due to the shock event is effectively drained off, returning the operating signal level at node 110 to about V-BIAS potential. The Ceq 102 and resistor 112 define an RC (resistive-capacitive) network which exhibits a corresponding time constant. The particular value of this time constant is primarily attributable to the high Ohmic value of resistor 112. In any case, the greater the time constant—typically measured in tens of seconds—the greater the delay while the RC network returns to quiescent operating conditions.

First Illustrative Implementation

Figure 2:
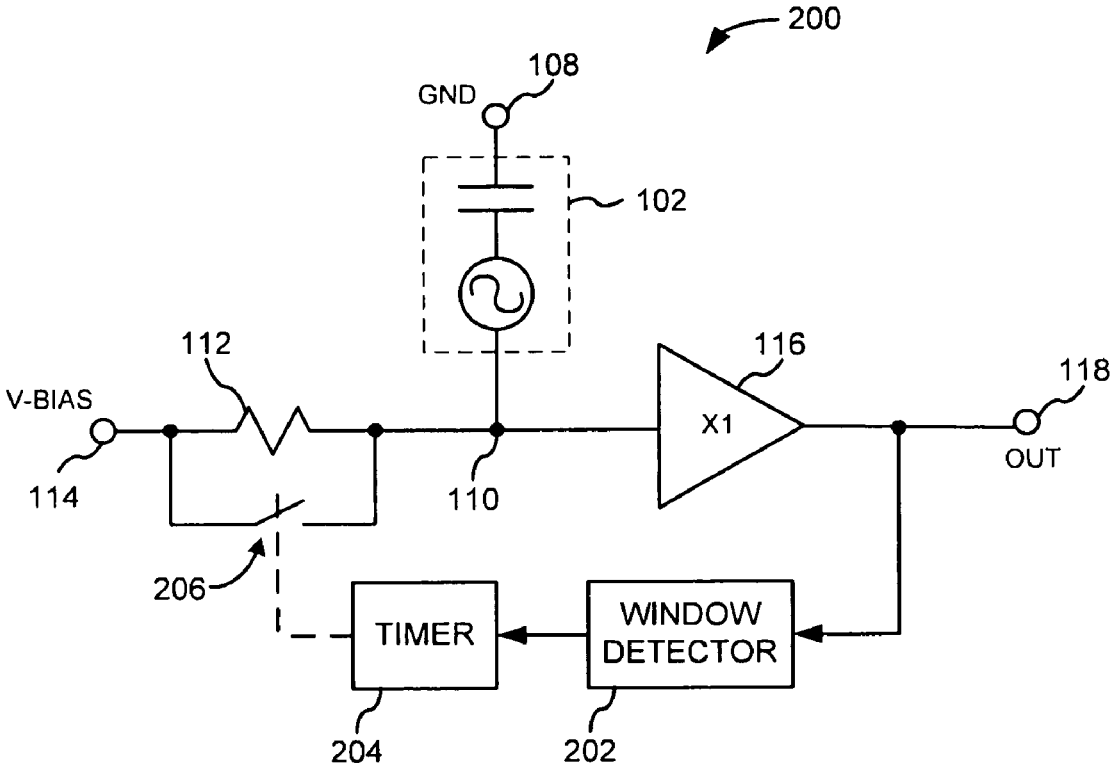
FIG. 2 is a schematic diagram of a biasing circuit including functional aspects in accordance with the present teachings.

FIG. 2 shows an illustrative circuit 200 in accordance with one implementation of the present teachings. The circuit 200 includes elements 102, 110, 112, 114, 116 and 118 substantially as defined and described above.

The circuit 200 also includes a window detector 202. The window detector 202 is configured to monitor the output signals from buffer 116 at node 118. The window detector 202 is also configured to provide a first detection signal in response to electrical signals at node 118 that are within some predefined, "normal" operating range. For purposes of non-limiting example, the operating range is defined by: (V-BIAS±0.5) volts. Thus, assuming a V-BIAS of 2.0 volts, a non-limiting, illustrative operating range of 1.5 to 2.5 volts can be defined. Other operating ranges corresponding to other implementations of the circuit 200 can also be defined and used. The window detector 202 is further configured to provide a second detection signal in response to electrical signals that exceed, above or below, the predefined operating range. In the non-limiting example set forth immediately above, such out-of-operating-range signals would be any that are less than 1.5 volts or greater than 2.5 volts.

The circuit 200 also includes a timer 204. The timer 204 is configured to receive the detection signals (defined as first and second levels or values) from the window detector 202. The timer 204 is configured to provide a first control signal output in response to a detection signal of the first type. In one or more implementations, the first control signal is an output level of about ground potential. The timer 204 provides the first control signal output as a continuous signal as long as electrical signals at node 118 remain within the defined operating range.

In response to a detection signal of the second type, the timer 204 is configured to provide a second control signal at a potential distinct from that of the first control signal. In one or more implementations, the second control signal is at a level of, for example, 2.0 volts DC. In any case, the second control signal is provided for a limited duration, after which the timer 204 returns to providing the first control signal type. The period of the second control signal can be any suitable time value. In one non-limiting implementation, the timer 204 is configured to provide the second control signal for about five milliseconds. Other time periods can also be used.

The circuit 200 includes a switch 206. Switch 206 is connected in parallel with the resistor 112 and is thus capable, when in a closed condition, of providing a direct electrical coupling between nodes 110 and 114. The switch 206 is also configured to be controlled by the control signal of the timer 204. The switch 206 is configured to assume an open condition in response to the first control signal from the timer 204. The switch 206 is further configured to assume a closed condition in response to the second control signal from the timer 204.

During typical, illustrative operation, the Ceq 102 detects speech or other sounds and provides electrical signals at node 110 that are within a normal, predefined operating range about V-BIAS. The buffer 116 provides (essentially) an electrical copy of these signals at node 118. During such normal operation, the window detector 202 provides a first detection signal that is received by the timer 204. The timer 204 provides a first control signal that serves to keep the switch 206 in an open condition. As a result, the Ceq 102 (i.e., the microphone represented thereby) is coupled to V-BIAS potential at node 114 by way of resistor 112.

Now, it is assumed that the Ceq 102 (i.e., microphone) is subjected to a "big signal" or shock event. For purposes of example, it is assumed that the Ceq 102 (i.e., microphone) is bumped by a user's hand. As a result, electrical signals that exceed the predefined operating range are suddenly present at node 110 and buffered to node 118. The capacitive membrane of Ceq 102 is assumed to be saturated (or nearly so) with electrical charge significantly greater than quiescent operating conditions.

In response to the out-of-operating-range condition, the window detector 202 provides a second detection signal that is received by timer 204. The timer 204 provides a limited duration second control signal that forces switch 206 into a closed condition. The Ceq 102 (i.e., microphone represented thereby) is now coupled directly to V-BIAS potential at node 114 by way of a very low (nearly zero) impedance electrical pathway. In this way, the electrical charge stored within the Ceq 102 is returned to V-BIAS level in a much shorter period of time than would occur if the excess charge were eliminated by way of the resistor 112. In effect, the RC time constant of the Ceq 102/resistor 112 network is circumvented in the interest of restoring normal bias conditions within the circuit 200.

Functional principles of the present teachings are depicted by the illustrative circuit 200. Particular and non-limiting implementations are considered hereinafter.

Second Illustrative Implementation

Figure 3:
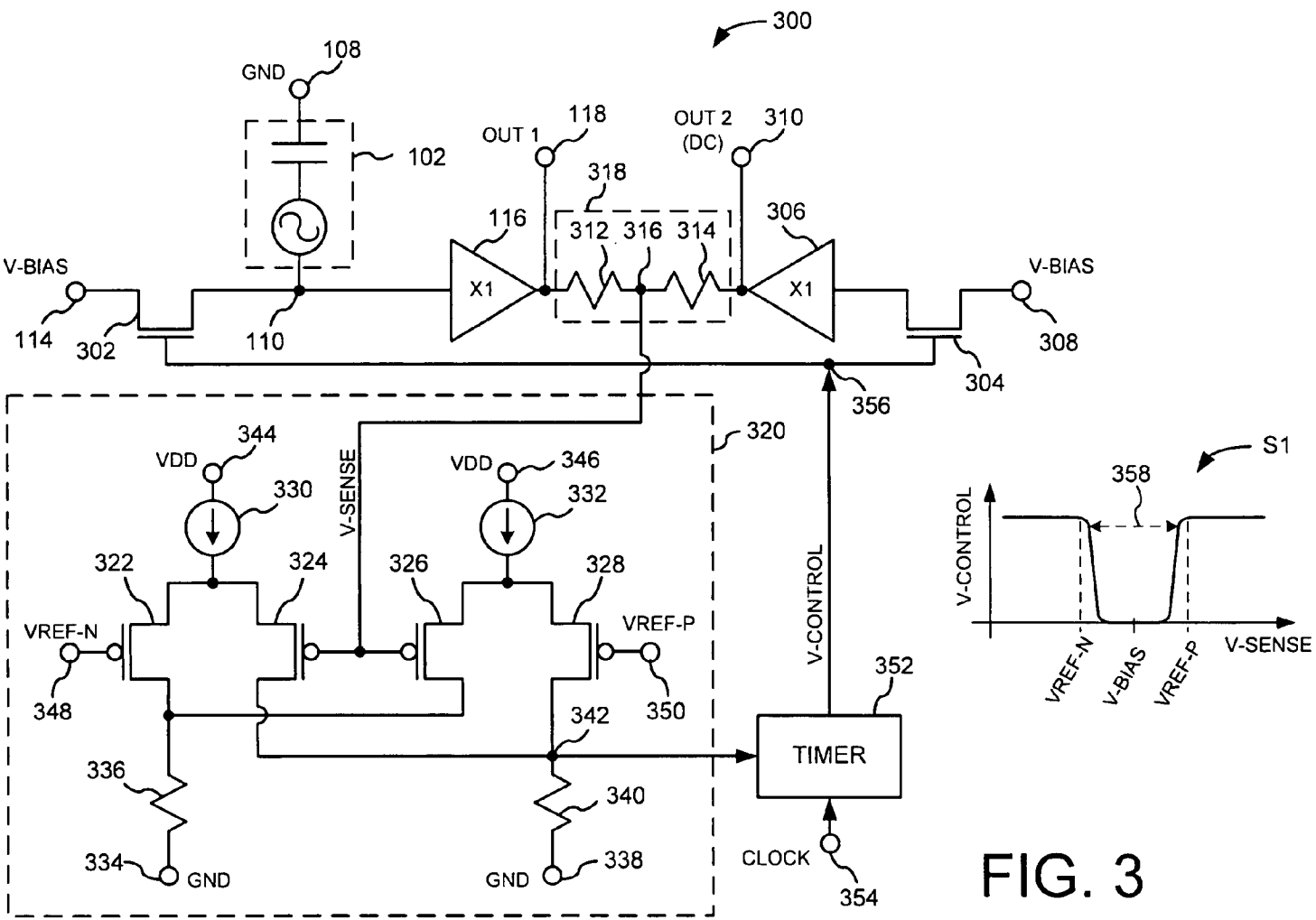
FIG. 3 a schematic diagram depicting a biasing circuit in accordance with the present teachings.

FIG. 3 a schematic diagram depicting a biasing circuit (circuit) 300 in accordance with the present teachings. The circuit 300 includes a Ceq 102, nodes 108 and 114, and a buffer amplifier 116 substantially defined and configured as described above. The buffer 116 is configured to provide an output at a node 118.

The circuit 300 includes a transistor 302. As depicted, the transistor 302 is defined by an N-channel metal-oxide semiconductor field effect transistor (NMOS). Other suitable types of transistor can also be used. For example, in an alternative implementation (not shown), the transistor 302 could be defined by a P-Channel metal-oxide semiconductor field effect transistor (PMOS). In another implementation (not shown), the transistor 302 is replaced with a combination of PMOS and NMOS transistor types. In any case, the transistor 302 is configured to couple the source of V-BIAS potential at node 114 to node 110 in accordance with control signals connected to the transistor 302. Further elaboration on such control signaling is provided hereinafter. Under normal operating conditions, the transistor 302 provides a very high Ohmic pathway coupling V-BIAS to the Ceq 102 in a manner analogous to the behavior of the resistor 112 of circuit 100.

The circuit 300 includes a second transistor 304. The transistor 304, as depicted, is defined by an NMOS transistor. Other suitable types of transistor can also be used. The circuit 300 further includes a second buffer 306. The buffer 306 is a unity gain buffer; however, other buffers of other suitable gain factors can also be used. The buffer 306 is coupled to a source of the V-BIAS potential by way of a node 308. The buffer 306 provides an output at a node 310. The circuit 300 includes a pair of resistors 312 and 314. The resistors 312 and 314 respectively couple the outputs at nodes 118 and 310 to a node 316. In this way, a common-mode extractor 318 is realized and provides a signal designated as V-SENSE at node 316.

The circuit 300 also includes circuitry defining a window detector 320. The window detector 320 includes four transistors 322-328, inclusive. As depicted, each of the transistors 322-328 is defined by a P-channel metal-oxide semiconductor field effect transistor (PMOS). Other suitable types of transistor can also be used. The transistors 322 and 324 have their respective sources connected to a current source 330, while the transistors 326 and 328 have their respective sources connected to a current source 332.

Transistors 322 and 326 have their respective drains coupled to a source of ground (GND) potential at a node 334 by way of a resistor 336. In turn, transistors 324 and 328 have their respective drains coupled to a source of ground potential at a node 338 by way of a resistor 340. The connection point common to transistor 324 and transistor 328 and the resistor 340 defines a window detector output node 342. The current sources 330 and 332 are connected to sources of positive (VDD) potential by way of respective nodes 344 and 346.

The transistor 322 has a control node (i.e., gate) that is connected to a source of reference voltage VREF-N at a node 348. The transistor 328 has a control node (i.e., gate) that is connected to a source of reference voltage VREF-P at a node 350. The particular voltage values of VREF-P and VREF-N can be respectively selected so as to define upper and lower boundaries of the normal operating range of the window detector 320. That is, VREF-P and VREF-N respectively define the upper and lower electrical signal limits that are considered normal for the Ceq 102. The transistors 324 and 326 have respective control nodes (i.e., gates) that are coupled to the V-SENSE signal provided at node 316. Thus, the respective conductive states of transistors 324 and 326 are controlled, at least in part, by the value of the V-SENSE signal.

In one non-limiting illustration, VREF-P equals 2.5 volts DC, while VREF-N equals 1.5 volts DC, thus defining an operating range 1 volt wide and centered on 2.0 volts DC (i.e., V-BIAS). Other values of VREF-P and VREF-N can also be used. Furthermore, symmetry about a V-BIAS is not a necessary condition under the present teachings, and asymmetrical range limits (with respect to V-BIAS) can also be used. In any case, the window detector provides a first detection signal at node 342 in response to V-SENSE signals (corresponding to detected sounds) that are within the operating range defined by VREF-P and VREF-N. The window detector further provides a second detection signal at node 342 in response to V-SENSE signals (corresponding to shock events) that fall above or below the operating range defined by VREF-P and VREF-N. The first and second detection signals are distinct and non-simultaneous in their provision at node 342. In other words, only one or the other of the first and second detection signals is present at node 342 at any given time.

The circuit 300 also includes a timer 352. The timer 352 is coupled to receive the node 342 so as to receive the first and second detection signals as they are provided by the window detector 320. The timer 352 is further coupled to a source of a clock signal at a node 354. The timer 352 is configured to function essentially as a resettable counter of clock pulses, providing a control signal designated as V-CONTROL at a node 356. The timer 352 provides a first control signal in response to the first detection signal at node 342. The first control signal is defined so as to keep the transistors 302 and 304 in respective very high impedance conditions, as during normal sound-sensing operation of the circuit 300.

The timer is further configured to provide a second control signal of limited duration in response to the second detection signal at node 342. The second control signal biases the transistors 302 and 304 into respective low impedance conditions in response to a shock event. The second control signal causes a coupling of V-BIAS potential to the Ceq 102 (i.e., microphone) such that the circuit 300 is returned to normal quiescent operating condition in a brief period of time.

FIG. 3 includes a signal diagram SI depicting the interrelationship of the signals V-SENSE, V-CONTROL, VREF-N, V-BIAS and VREF-P. As depicted, a normal operating range 358 is defined about the V-BIAS value, while out-of-operating-range conditions are defined above and below the range 358. Table 1 below provides illustrative, non-limiting operating voltage and signal values in accordance with one implementation of the circuit 300. Other implementations having correspondingly varying operating values can also be used.

TABLE 1

| ILLUSTRATIVE VALUES | |
|---|---|
| VDD | 2.5 Volts |
| V-BIAS | 2.0 Volts |
| VREF-P | 2.5 Volts |
| VREF-N | 1.5 Volts |
| V-CONTROL ($1^{st}$) | 0.0 Volts (ground) |
| V-CONTROL ($2^{nd}$) | 2.5 Volts |

Operation of the circuit 300 is substantially as defined above with regard to circuit 200. The window detector 320 operates in a manner similar to the window detector 202, while the timer 352 operates in a manner similar to the timer 204. The transistor 302 provides a very high resistance electrical coupling of V-BIAS potential to Ceq 102 while V-CONTROL is in the first control signal state (i.e., normal operating conditions). In turn, transistor 302 provides a relatively low resistance electrical coupling of V-BIAS to Ceq 102 when V-CONTROL is in the second control signal state (i.e., shock event conditions).

Third Illustrative Implementation

Figure 4:
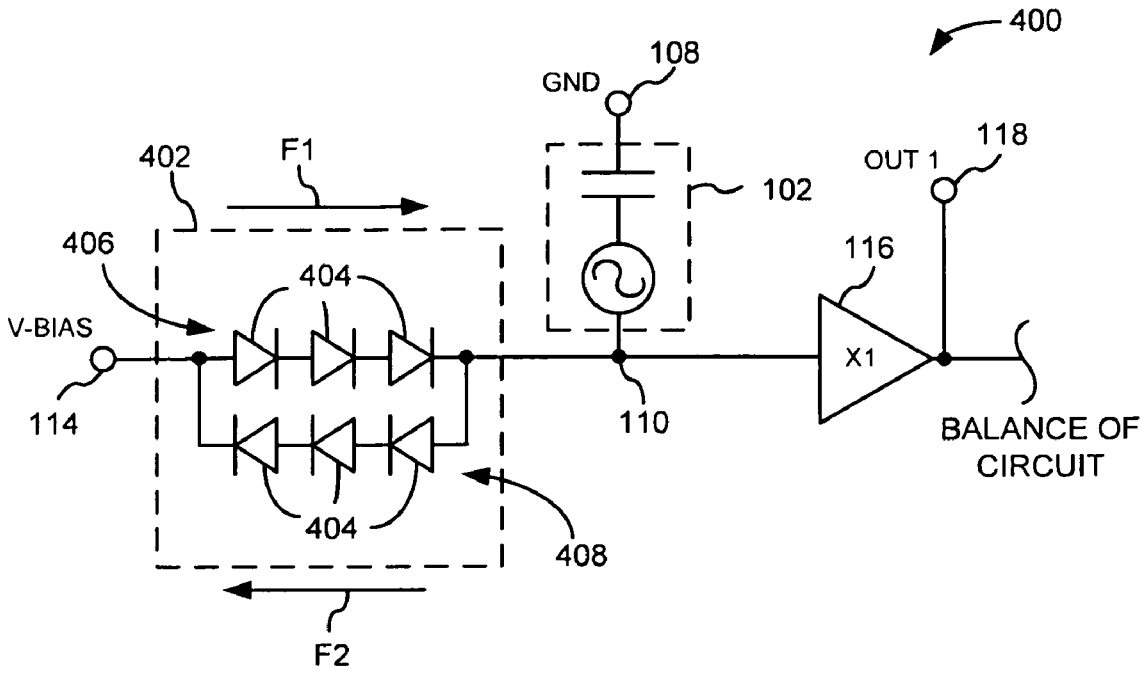
FIG. 4 is a schematic diagram depicting another biasing circuit in accordance with the present teachings.

FIG. 4 is a schematic diagram depicting a biasing circuit (circuit) 400 in accordance with the present teachings. The circuit 400 includes a Ceq (i.e., microphone equivalent) 102 connected to a ground potential node 108, a node 110 connected to the Ceq 102, a source of V-BIAS potential at a node 114, and a buffer 116 with an output node 118 substantially as described above. The circuit 400 can be a part of a larger circuit arrangement that includes other functional elements. However, such other aspects as may or may not be present are not relevant to an understanding of the present teachings. In any case, it is noted that neither a window detector (e.g., 202, 320) nor a timer (e.g., 204, 352) are included in the circuit 400.

The circuit 400 also includes a sub-circuit 402. The sub-circuit 402 includes three diodes 404 connected in a series circuit arrangement 406. As such, the diodes 404 of the arrangement 406 are polarized to electrically conduct in a first forward direction F1. Each of the diodes 404 of arrangement 406 is characterized by a respective forward voltage drop when operating in a normal, conductive mode in the direction F1. Thus, a collective voltage drop is present across the arrangement 406 during forward conduction. A potential difference between nodes 114 (positive) and 110 (negative) equal to or greater than the collective voltage drop is required in order to bias the arrangement 406 into forward conduction in the direction F1.

The sub-circuit 402 further includes three more diodes 404 connected in a series circuit arrangement 408. As such, the diodes 404 of the arrangement 408 are polarized to electrically conduct in a second forward direction F2. The diodes 404 of arrangement 408 are respectively characterized by a forward voltage drop when operating in a conductive mode in the direction F2. Thus, a cumulative voltage drop is present across the arrangement 408 during forward conduction. A potential difference between nodes 110 (positive) and 114 (negative) equal to or greater than the collective voltage drop is required in order to bias the arrangement 408 into forward conduction. When neither of the arrangements 406 or 408 is in a forward biased condition, only a very small leakage current flows through the sub-circuit 402.

During typical, illustrative operation of the circuit 400, there is a relatively small potential difference between node 110 and 114 (irrespective of polarity). Under these normal conditions, a very small leakage current through the sub-circuit 402 provides what is essentially a very high resistance coupling of V-BIAS potential to the Ceq 102 at node 110. Ceq 102 (i.e., microphone) detects sounds such as speech, etc., and provides correspondingly varying electrical signals at node 110 that are "copied" to node 118 by way of buffer 116. This normal operating mode continues provided that sound levels detected by Ceq 102 remain within a normal operating range. The limits of the normal operating range are substantially determined by the respective forward voltage drops of arrangements 406 and 408.

Now, it is assumed that a shock event occurs, such as dropping the microphone represented by Ceq 102. Ceq 102 now stores an electric charge outside of the normal operating range. In one non-limiting example, near ground potential is assumed to be present at node 110. It is further assumed, for purposes of illustration, that V-BIAS potential is 2.0 volts DC. Thus, about two volts of potential difference is present between nodes 110 and 114, with node 114 being relatively positive in polarity.

As a result of the foregoing, the diodes 404 of the arrangement 406 are forward biased into a conductive state and current flows from node 114 to node 110 (direction F1) at an appreciably higher rate than the normal leakage value. Arrangement 406 now appears as a relatively low resistance path between nodes 114 and 110. The electrical charge stored by Ceq 102 is rapidly dissipated by the forward conductive behavior of the arrangement 406, restoring the Ceq 102 to quiescent operating conditions in a relatively brief period of time. Once normal operating conditions are restored, or nearly so, the diodes 404 of arrangement 406 resume their non-forward biased condition and current flow through the sub-circuit 402 returns to leakage levels.

It is now assumed that a second shock event occurs, such that a potential of 3.2 volts is present at node 110. In this case, node 110 is of positive polarity relative to node 114, and the diodes 404 of arrangement 408 are forward biased into conduction. As such, current flows in the direction F2 so as to discharge Ceq 102 toward V-BIAS potential. Once quiescent conditions are restored, or nearly so, the diodes 404 of arrangement 408 resume their non-forward biased condition and current flow through the sub-circuit 402 returns to leakage levels.

The sub-circuit 402 of circuit 400 provides leakage-level electrical current between nodes 110 and 114 at a first, relatively high impedance during normal operating conditions. The sub-circuit 402 of circuit 400 also provides restorative electrical current between nodes 110 and 114 at a second, relatively low impedance under "big signal" or shock conditions. The sub-circuit 402 exhibits a normal operating range defined by the respective forward voltage drops defined by the polarized arrangements 406 and 408. Thus, the respective range limits (and thus the width) of the operating range can be selected by way of the forward voltage drops of the respective diodes 404.

While the circuit 400 includes a total of six diodes, it is to be understood that other implementations including other numbers of diodes can also be used. In one non-limiting example, a sub-circuit (not shown) is provided that includes a first arrangement (i.e., polarized in direction F1) of two diodes and a second arrangement (i.e., polarized in direction F2) of one diode. Additionally, the forward voltage drop of each diode within a sub-circuit can be individually selected so that an overall forward drop for the corresponding arrangement (e.g., 406 or 408) can be "tuned" as desired. Thus, while the sub-circuit 402 depicts a total of six equivalent diodes 404, the present teachings envision other implementations that vary accordingly.

Fourth Illustrative Implementation

Figure 5:
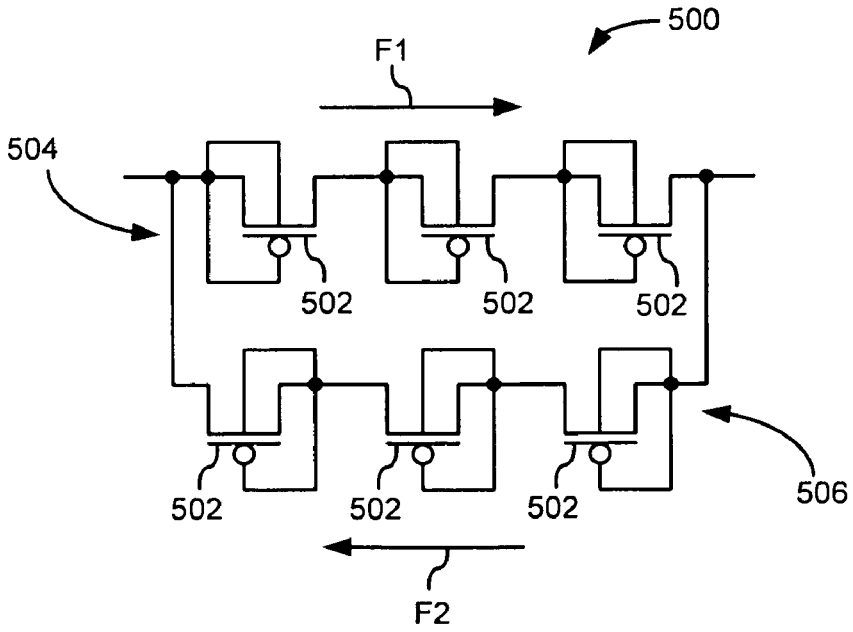
FIG. 5 is a schematic diagram depicting a biasing circuit portion in accordance with the present teachings.

FIG. 5 is a schematic diagram depicting a circuit 500 in accordance with the present teachings. The circuit 500 can be referred to as a sub-circuit or portion of a biasing circuit according to the teachings herein. The circuit 500 is an alternative implementation analogous to, and usable in place of, the sub-circuit 402 within the circuit 400. Thus, the circuit 500 would serve to couple nodes 110 and 114 in FIG. 4.

The circuit 500 includes six transistors 502 connected to define respective series circuit arrangements 504 and 506. As depicted, each of the transistors 502 is a P-channel metal-oxide semiconductor field effect transistor (PMOS). Other suitable types of transistor 502 can also be used. In one or more implementations, the transistors 502 are fabricated on a substrate in separate N-type wells, such that at least a portion of an integrated circuit is defined. Other constructs can also be used.

The circuit 500 is configured to provide a low, leakage-level current there through when the electrical potential across the circuit 500 is less than the forward conduction level for either of arrangements 504 or 506. Thus, under normal sound detection operating conditions of circuit 400, V-BIAS level potential is provided to Ceq 102 at relatively high impedance by way of circuit 500. Under shock event conditions, a forward conductive path is provided through one of arrangements 504 or 506 (depending on polarity) so as to couple V-BIAS potential to the Ceq 102 at substantially lower impedance than during normal quiescent conditions.

The circuit 500 includes a total of six transistors. However, it is to be understood that other implementations including other numbers of transistors can also be used. In one non-limiting example, a circuit (not shown) is provided that includes a first arrangement (i.e., polarized in direction F1) of two transistors and a second arrangement (i.e., polarized in direction F2) of three transistors. Additionally, the forward voltage drop of each transistor within a circuit can be individually selected so that an overall forward drop for the corresponding arrangement (e.g., 504 or 506) can be set as desired. Thus, while the circuit 500 depicts a total of six equivalent transistors 502, the present teachings envision other implementations that vary accordingly.

Illustrative Operation

Figure 6:
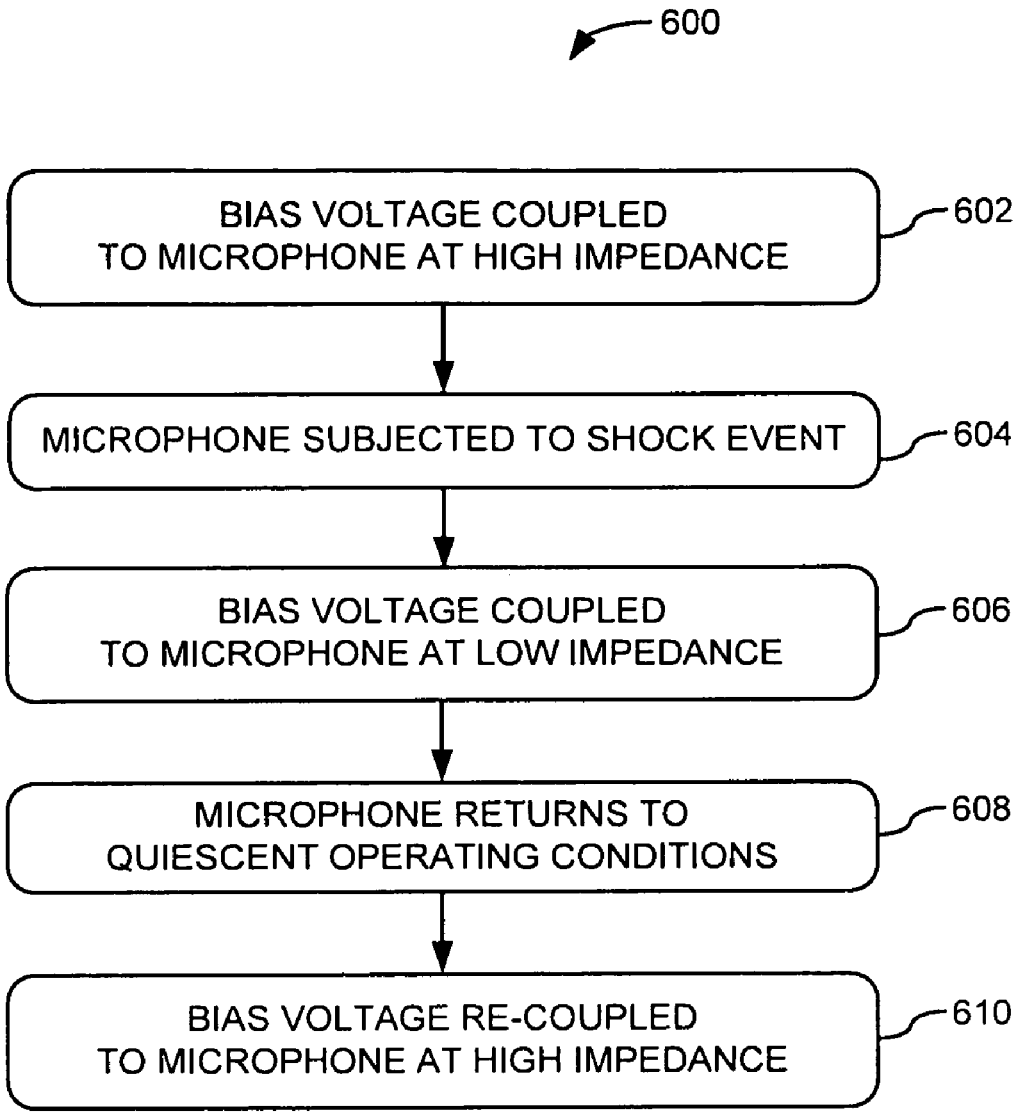
FIG. 6 is a flow diagram depicting operations in accordance with the present teachings.

FIG. 6 is a flow diagram depicting a method 600 in accordance with another implementation. The method 600 depicts particular steps in a particular order of execution. However, certain steps can be omitted or other steps added, and/or other orders of execution can also be performed, without departing from the scope of the present teachings. The method 600 depicts a flow of distinct and discrete events in the interest of clarity of understanding. However, one of skill in the electrical arts can appreciate that the method 600 can operate in an essentially continuous manner, smoothly transitioning from one step to the next.

At 602, a capacitive-type microphone is coupled to a bias voltage at relatively high impedance. Such high impedance is assumed to be used in the interest of favorable signal-to-noise ratio (SNR) performance.

At 604, the microphone is subjected to a shock or "big signal" event, such as being dropped onto a table top surface. As a result, an abnormally high (or low) charge is stored in the capacitive element or membrane of the microphone. The microphone is now outside of its normal or quiescent operating condition and cannot function to provide usable electrical signals corresponding to incident sound energy.

At 606, the bias voltage is coupled to the microphone at relatively low impedance. Typically, this low impedance is orders of magnitude less than the high impedance of step 602 above. In any case, the abnormally high (or low) charge stored within the microphone due to the shock event can now be dissipated in a relatively brief period of time.

At 608, the shock event-related charge within the microphone is quickly dissipated and the microphone returns to quiescent operating conditions at or about bias voltage level.

At 610, bias voltage is coupled to the microphone at the original high impedance level. As such, the microphone can return to sound detection and the provision of corresponding electrical signals.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as preferred forms of implementing the claims.

The invention claimed is:

1. An electronic circuit, comprising:

a single source to produce a biasing voltage;

biasing circuitry configured to electrically couple a microphone to the biasing voltage of the single source at a first impedance during a first set of operating conditions, the biasing circuitry further configured to electrically couple the microphone to the biasing voltage of the single source at a second impedance during a second set of operating conditions; and a window detector associated with the biasing circuitry, the window detector in a feedback path of the electronic circuit.

2. The electronic circuit according to claim 1, wherein:

the first set of operating conditions includes electrical signals provided by the microphone within a predetermined operating range;

the second set of operating conditions includes electrical signals provided by the microphone the level of which is either greater or lesser than the operating range; and the first impedance value is one million times greater than the second impedance value.

3. The electronic circuit according to claim 1, wherein the window detector configured to provide distinct first and second detection signals respectively corresponding to the first and second sets of operating conditions, the window detector further configured to provide the distinct first and second detection signals respectively corresponding to the first and second sets of operating conditions based on one or more output signals of the electronic circuit.

4. The electronic circuit according to claim 3, wherein the biasing circuitry includes a timer configured to provide:

a first control signal in response to the first detection signal; and a second control signal in response to the second detection signal, the first control signal distinct from the second control signal.

5. The electronic circuit according to claim 4, wherein the biasing circuitry includes a metal oxide semiconductor (MOS) transistor including a control node coupled to the timer, the MOS transistor configured to:

electrically couple the microphone to the source of biasing voltage at the first impedance in response to the first control signal; and electrically couple the microphone to the source of biasing voltage at the second impedance in response to the second control signal.

6. The electronic circuit according to claim 4, wherein the biasing circuitry includes:

a common mode extractor configured to receive electrical signals provided by the microphone, the common mode extractor including a buffer amplifier; and a metal oxide semiconductor (MOS) transistor including a control node coupled to the timer, the MOS transistor configured to:

electrically couple the buffer amplifier to the source of biasing voltage at the first impedance in response to the first control signal; and electrically couple the buffer amplifier to the source of biasing voltage at the second impedance in response to the second control signal.

7. The electronic circuit according to claim 1, wherein the biasing circuitry includes:

a first circuit arrangement configured to electrically couple the microphone to the source of biasing voltage at the respective first and second impedances in a first polarized direction; and a second circuit arrangement configured to electrically couple the microphone to the source of biasing voltage at the respective first and second impedances in a second polarized direction opposite to the first polarized direction.

8. The electronic circuit according to claim 7, wherein:

the first circuit arrangement includes one or more diodes coupled in series circuit orientation in the first polarized direction; and the second circuit arrangement includes one or more diodes coupled in series circuit orientation in the second polarized direction.

9. The electronic circuit according to claim 7, wherein:

the first circuit arrangement includes one or more metal-oxide semiconductor (MOS) transistors coupled in series circuit orientation in the first polarized direction; and the second circuit arrangement includes one or more MOS transistors coupled in series circuit orientation in the second polarized direction.

10. The electronic circuit according to claim 1, wherein at least a portion of the electronic circuit is fabricated within a 65 nanometer environment.

11. The electronic circuit according to claim 1, wherein the window detector is configured to provide distinct first and second detection signals respectively corresponding to the first and second sets of operating conditions based on one or more output signals of the electronic circuit.

12. An electronic circuit for use with a microphone, the electronic circuit configured to:

electrically couple the microphone to a single source to produce a biasing voltage at a first impedance in response to electrical signals provided by the microphone within a predefined operating range; and electrically couple the microphone to the single source to produce the biasing voltage at a second impedance in response to electrical signals provided by the microphone that are not within the predefined operating range, wherein the electronic circuit includes a window detector configured to provide:

a first detection signal in response to electrical signals provided by the microphone that are within the predefined operating range; and a second detection signal in response to electrical signals provided by the microphone that are not within the predefined operating range.

13. The electronic circuit according to claim 12, wherein the electronic circuit includes a timer coupled to the window detector, the timer configured to provide:

a first control signal in response to the first detection signal; and a limited duration second control signal in response to the second detection signal, the first control signal distinct from the second control signal.

14. The electronic circuit according to claim 13, wherein the electronic circuit includes a metal-oxide semiconductor (MOS) transistor configured to:

electrically couple the microphone to the source of biasing voltage at the first impedance in response to the first control signal; and electrically couple the microphone to the source of biasing voltage at the second impedance in response to the second control signal.

15. The electronic circuit according to claim 13, wherein the electronic circuit includes a buffer amplifier and a metal-oxide semiconductor (MOS) transistor, the MOS transistor configured to:

electrically couple the buffer amplifier to the source of biasing voltage at the first impedance in response to the first control signal; and electrically couple the buffer amplifier to the source of biasing voltage at the second impedance in response to the second control signal.

16. The electronic circuit according to claim 12, wherein at least a portion of the electronic circuit is fabricated within a 65 nanometer environment.

17. An electronic device, comprising:

a node configured to receive electrical signals from a microphone;

a first transistor and a second transistor and a third transistor and a fourth transistor fabricated on a substrate, the first and the second and the third and the fourth transistors defining at least a portion of a window detector, the window detector configured to provide:

a first detection signal in response to electrical signals received from the microphone that are within a predefined operating range; and a second detection signal in response to electrical signals received from the microphone that are not within the predefined operating range;

a timer fabricated at least in part on the substrate, the timer configured to provide a first control signal in response to the first detection signal, the timer further configured to provide a second control signal in response to the second detection signal; and a fifth transistor fabricated on the substrate, the fifth transistor configured to electrically couple a source of a biasing voltage to the node at a first impedance and at a second impedance in response to the first and second control signals, respectively.

18. The electronic device according to claim 17, further comprising a common mode extractor fabricated at least in part on the substrate, the common mode extractor including a buffer amplifier and a sixth transistor, the sixth transistor configured to electrically couple the buffer amplifier with the source of biasing voltage at the first and second impedances in response to the first and second control signals, respectively.

19. The electronic device according to claim 17, wherein:

the first transistor includes a control node configured to be electrically coupled to a source of a first reference voltage;

the second transistor includes a control node configured to be electrically coupled to a source of a second reference voltage; and the first and second reference voltages correspond to respective limits of the operating range.

20. The electronic device according to claim 17, wherein the timer is further configured to be electrically coupled to a source of a clock signal.

21. The electronic device according to claim 17, wherein at least a portion of the electronic device is fabricated in a 65 nanometer environment.

22. An electronic device, comprising:

a node configured to receive electrical signals from a microphone;

a circuit arrangement fabricated on a substrate, the circuit arrangement configured to electrically couple the node to a source of biasing voltage at a first impedance in a polarized direction in response to electrical signals from the microphone within a predefined operating range, the circuit arrangement further configured to electrically couple the node to the source of biasing voltage at a second impedance in the polarized direction in response to electrical signals from the microphone not within the operating range.

23. The electronic device according to claim 22, wherein the circuit arrangement includes at least one diode or transistor arranged in the first polarized direction.

24. An electronic circuit for use with a microphone, the electronic circuit configured to:

electrically couple the microphone to a single source to produce a biasing voltage at a first impedance in response to electrical signals provided by the microphone within a predefined operating range; and electrically couple the microphone to the single source to produce the biasing voltage at a second impedance in response to electrical signals provided by the microphone that are not within the predefined operating range, wherein the electronic circuit includes:

a first circuit arrangement of one or more devices coupled in series circuit orientation in a first polarized direction; and a second circuit arrangement of one or more devices coupled in series circuit orientation in a second polarized direction.

25. The electronic circuit according to claim 24, wherein the one or more devices coupled in series circuit orientation in a first polarized direction and the one or more devices coupled in series circuit orientation in a second polarized direction are each a diode.

26. The electronic circuit according to claim 24, wherein the one or more devices coupled in series circuit orientation in a first polarized direction and the one or more devices coupled in series circuit orientation in a second polarized direction are each a metal-oxide semiconductor (MOS) transistor.

* * * * *